US006847339B2

(12) United States Patent
Haginoya

(10) Patent No.: US 6,847,339 B2
(45) Date of Patent: Jan. 25, 2005

(54) METHOD AND DEVICE FOR DRIVING PLASMA DISPLAY PANEL

(76) Inventor: Naoki Haginoya, c/o NEC Corporation, 7-1, Shiba 5-chome, Minato-ku, Tokyo (JP)

( * ) Notice: Subject to any disclaimer, the term of this patent is extended or adjusted under 35 U.S.C. 154(b) by 0 days.

(21) Appl. No.: 10/365,971

(22) Filed: Feb. 13, 2003

(65) Prior Publication Data

US 2003/0122741 A1 Jul. 3, 2003

Related U.S. Application Data

(63) Continuation of application No. 09/521,277, filed on Mar. 8, 2000.

(30) Foreign Application Priority Data

Mar. 9, 1999 (JP) ..... 11-061342

(51) Int. Cl.[7] ..... G09G 3/28
(52) U.S. Cl. ..... 345/60; 345/63
(58) Field of Search ..... 345/60, 55, 596, 345/690, 63

(56) References Cited

U.S. PATENT DOCUMENTS 6,331,843 B1 * 12/2001 Kasahara et al. ..... 345/63
6,690,388 B2 * 2/2004 Kasahara et al. ..... 345/690

FOREIGN PATENT DOCUMENTS

| | | | | |
|---|---|---|---|---|
| EP | 845769 A1 * | 6/1998 | ..... | G09G/3/28 |
| EP | 847037 A1 * | 6/1998 | ..... | G09G/3/28 |
| EP | 945844 A2 * | 9/1999 | ..... | G09G/3/28 |

* cited by examiner

*Primary Examiner*—Dennis-Doon Chow
*Assistant Examiner*—Uchendu O. Anyaso
(74) *Attorney, Agent, or Firm*—Morgan, Lewis & Bockius LLP

(57) ABSTRACT

A frequency monitoring circuit supplies a signal for selecting a sequence data set to a sequence data storage circuit when a frequency of a vertical synchronization signal which is input through an input terminal is higher than a predetermined frequency, in order to generate a shortened sub field sequence by a sequence generator circuit. The sequence generator circuit reads the sequence data set, which is allowed to be read by the sequence generator circuit based on the signal supplied, from the frequency monitoring circuit from the sequence data storage circuit. The sequence generator circuit generates a drive sequence based on the read sequence data set. The sequence generator circuit supplies the generated drive sequence to a data selector circuit and a drive circuit to drive a plasma display panel properly.

11 Claims, 7 Drawing Sheets

METHOD AND DEVICE FOR DRIVING PLASMA DISPLAY PANEL

CROSS REFERENCE TO RELATED APPLICATIONS

This application is a continuation of U.S. patent application Ser. No. 09/521,277 filed Mar. 8, 2000 (pending).

BACKGROUND OF THE INVENTION

1. Field of the Invention

The present invention relates to a method and device for driving a plasma display panel which can display an image including various brightness levels.

2. Description of the Related Art

A plasma display panel has been known as one of flat display panels. In the plasma display, activated phosphor acts as illuminant for display. More precisely, the plasma display panel comprises multiple discharge cells each having the phosphor therein. The phosphor is activated by ultraviolet rays generated by gas discharge performed in each cell.

Some of developed plasma displays can display an image including various brightness levels. Such the plasma display panel is useful for a flat television display, a public display panel, etc.

The plasma display panel usually has a drive device which controls outputs of each discharge cell, so as to drive the display panel. The drive device must control the number of outputs in a unit of time in every cell operation for displaying an image including various brightness levels. A known sequence for controlling the number of outputs is a drive sequence which is so called sub field sequence. In the sub field sequence, each field has a plurality of sub fields.

In a case where the drive device employs such the sub field sequence to display an image including various brightness levels, a plurality of images each represented by binary data are displayed on the display panel while the images are being switched very quickly. That is, visual storage effect causes an observer to recognize the plurality of images being switched as one image including various brightness levels.

Since the plasma display panel can not adjust brightness level by controlling voltages, the driving method utilizing the sub field sequence is employed. In other words, each cell merely shows two phases, output and rest.

FIGS. 1A and 1B are diagrams for explaining conventionally used sub field sequence. The shown drive sequence has eight sub fields (SF1 to SF8), thus, the maximum number of allowable brightness levels is 256. In this case, the sub fields SF1, SF2, . . . , SF7, SF8 correspond to MSB (Most Significant Bit), second bit, . . . , seventh bit, LSB (Least Significant Bit) respectively. And they are weighted with brightness ratio of $128(2^7)$, $64(2^6)$, . . . , $2(2^1)$, $1(2^0)$ respectively. The drive device of the plasma display panel selects the sub field in accordance with brightness level represented by a supplied video signal in order to display an image including various brightness levels.

Each of the sub fields has two sections, a scan period t1 and a sustain period t2. During the scan period t1, the drive device determines the phase (output or rest) of each cell while scanning the plasma display panel. During the sustain period t2, the cells in the output phase, in accordance with the determination during the scan period t1, output lights. The number of outputs during the sustain period t2 depends on the number of sustain pulses. The sustain pulse provides appropriate brightness in accordance with sub field position.

The length of the scan period t1 is constant. That is, all sub fields have the same scan period t1 regardless of the differences in the brightness ratio applied to each sub field.

Since the sub field sequence is a sequence on the time axis for controlling the plasma display panel to drive it, cases where some sub fields have insufficient sustain period t2 may appear when an externally supplied vertical synchronization signal has a high frequency.

In a case of a high resolution panel, it is difficult to obtain the number of brightness levels because the sub field sequence must scan many lines. If worst comes to worst, it is impossible to obtain the necessary minimum number of brightness levels necessary for displaying an image.

A sequence more complex than that shown in FIG. 1B has been applied to a full-color plasma display panel in practical use, in order to prevent unnecessary images being displayed during motion image display.

For example, Unexamined Japanese Patent Application KOKAI Publicaation No. H9-127911 discloses a technique which disperses output sub frames and rest sub frames. The disclosure is incorporated herein by reference in its entirety.

Moreover, a method for dispersing upper bits in a sub field, a method for linearizing data representing brightness level, and the like have been proposed or in practical use.

In the above cases, a drive sequence requires sub fields more than 8 in order to display an image including 256 brightness levels on a plasma display panel, therefore, it is more difficult to obtain sufficient sustain period t2.

In the high resolution panel, the scan period t1, which determines the output phase, almost occupies a sequence period in 1 field.

For example, in an NTSC (National Television System Committee) or HDTV (High Definition Television) video signal, the length of a period in 1 field is set to 1/60 second.

In a case where a drive device drives a plasma display panel employing XGA (extended Graphic Array) for 1024×768 display area with utilizing a video signal of NTSC or HDTV including 8 sub fields, total length of the scan period t1 reaches 12 ms or more even if writing for 1 line can be done within approximately 2 microseconds.

Since 1/60 second is approximately 16.7 ms, applicable length to the sustain period t2 is approximately 4 ms.

If such the display panel employs the above described sequence for canceling unnecessary image display, the applicable length to the sustain period t2 will be reduced. If the display panel employs higher resolution rather than XGA, the applicable length to the sustain period t2 will be reduced further, because of extended scan period t1 caused by increased number of scan lines. As a result, it is difficult to obtain sufficient sustain period t2.

Moreover, the length of period in 1 field will be shorter than 1/60 second while the drive device is dealing with a video signal supplied from a VCR (Video Cassette Recorder) performing play back option (fast forward, rewind, etc.) or a video game device or the like. Therefore, it is also difficult to obtain sufficient sustain period t2.

SUMMARY OF THE INVENTION

It is an object of the present invention to provide a method and device suitable for driving a plasma display panel.

To accomplish the above object, a method for driving a plasma display panel according to a first aspect of the present invention is a method for driving the plasma display panel with utilizing sub field sequences in which each field has a plurality of sub fields, the method comprises:

driving the plasma display panel with utilizing a predetermined first sub field sequence when a frequency of an externally supplied vertical synchronization signal is equal to or lower than a predetermined frequency; and driving the plasma display panel with utilizing a second sub field sequence whose field length is shorter than field length of the first sub field sequence when the frequency of the externally supplied vertical synchronization signal is higher than the predetermined frequency.

According to this invention, a sub field sequence whose field length is shorter than that of a normal sub field sequence is selected if the frequency of the vertical synchronization signal is high. Thus, the plasma display panel is driven properly.

The second sub field sequence may be a sub field sequence in which a predetermined sub field lacks for the first sub field sequence.

The second sub field sequence may be a sub field sequence in which sustain pulses are reduced so that the second sub field sequence is shorter than the first sub field sequence.

The second sub field sequence may be a sub field sequence in which a predetermined sub field lacks for the first sub field sequence and sustain pulses are reduced so that the second sub field sequence is shorter than the first sub field sequence.

More precisely, the method comprises:

previously storing on a memory plural kinds of data sets prepared for generating plural kinds of the sub field sequences including the first and second sub field sequences;

specifying the frequency of the externally supplied vertical synchronization signal, and selecting a readable data set from the data sets in the memory in accordance with the specified frequency;

reading the readable data set from the memory;

generating a sub frame sequence in accordance with the read data set; and driving the plasma display panel in accordance with the generated sub frame sequence.

The data set prepared for generating the second sub field sequence may be selected as the readable data set from the data sets in the memory while the vertical synchronization signal is not being supplied. Thus, synchronization is established quickly immediately after the vertical synchronization signal is supplied, to drive the plasma display panel properly.

Moreover, the method may comprise:

writing externally supplied image data on a field memory;

reading the image data from the field memory at a timing asynchronous with a writing timing; and supplying the read image data to the plasma display panel.

To accomplish the above object, a device for driving a plasma display panel according to a second aspect of the present invention is a device comprises for driving the plasma display panel with utilizing sub field sequences in which each field has a plurality of sub fields, the device comprises:

a generator circuit for generating the sub field sequences;

a drive circuit for driving the plasma display panel in accordance with the sub field sequences generated by the generator circuit;

a storage circuit for storing plural kinds of data sets prepared for generating plural kinds of the sub field sequences by the generator circuit; and a selector circuit for specifying a frequency of a vertical synchronization signal which is externally supplied through an input terminal, and for selecting a data set, which is readable by the generator circuit, from the data sets stored in the storage circuit in accordance with the specified frequency, wherein the generator circuit reads the readable data set from the storage circuit, and generates the sub field sequence in accordance with the read data set.

According to this embodiment, the device for driving the plasma display panel can drive the plasma display panel properly with utilizing plural kinds of sub field sequences corresponding to a frequency of the vertical synchronization signal input through the input terminal.

The readable data set while a low frequency vertical synchronization signal is being supplied is a data set which has been prepared for generating the a predetermined first sub field sequence. On the contrary, the readable data set while a high frequency vertical synchronization signal is being supplied is a data set which has been prepared for generating a second sub field sequence whose field length is shorter than field length of the first sub field sequence.

The generator circuit may generate the second sub field sequence which is a sub field sequence in which a predetermined sub field lacks for the first sub field sequence.

Or, the generator circuit may generate the second sub field sequence which is a sub field sequence in which sustain pulses are reduced so that the second sub field sequence is shorter than the first sub field sequence.

Or, the generator circuit may generate the second sub field sequence which is a sub field sequence in which a predetermined sub field lacks for the first sub field sequence and sustain pulses are reduced so that the second sub field sequence is shorter than the first sub field sequence.

Moreover, the selector circuit may select one of the data sets in the storage circuit which is prepared for generating the second sub field sequence by the generator circuit, as the readable data set while the vertical synchronization signal is not being supplied. Thus, synchronization is established quickly immediately after the vertical synchronization signal is supplied, to drive the plasma display panel properly.

Further, the device may comprise:

a field memory for storing image data supplied through the input terminal; and a supply circuit for reading the image data from the field memory, and supplying the read image data to the plasma display panel, wherein the supply circuit reads the image data at a timing asynchronous with a storing timing of the field memory.

To accomplish the above object, a device for driving a plasma display panel according to a third aspect of the present invention is a device for driving the plasma display panel with utilizing sub field sequences in which each field has a plurality of sub fields, the device comprises:

generating means for generating the sub field sequences;

drive means for driving the plasma display panel in accordance with the sub field sequences generated by the generating means;

storage means for storing plural kinds of data sets prepared for generating plural kinds of the sub field sequences by the generating means; and selecting means for specifying a frequency of an externally supplied vertical synchronization signal, and for selecting a data set which is readable by the generating means from the data sets stored in the storage means in accordance with the specified frequency, wherein the selecting means selects a data set which is prepared for generating a predetermined first sub field sequence by the generating means from the data sets stored in the storage means as the readable data set when the frequency of the externally supplied vertical synchronization signal is equal to or lower than a predetermined frequency, and selects another data set which is prepared for generating a predetermined second sub field sequence whose field length is shorter than field length of the first sub field sequence by the generating means from the data sets stored in the storage means as the readable data set when the frequency of the externally supplied vertical synchronization signal is higher than the predetermined frequency, and the generating means reads the readable data set from the storage means, and generates the sub field sequence in accordance with the read data set.

The generating means may generate the second sub field sequence which is a sub field sequence in which a predetermined sub field lacks for the first sub field sequence, if the data set read from the storage means is prepared for generating the second sub field sequence.

Or, the generating means may generate the second sub field sequence which is a sub field sequence in which sustain pulses are reduced so that the second sub field sequence is shorter than the first sub field sequence, if the data set read from the storage means is prepared for generating the second sub field sequence.

Or, the generating means may generate the second sub field sequence which is a sub field sequence in which a predetermined sub field lacks for the first sub field sequence and sustain pulses are reduced so that the second sub field sequence is shorter than the first sub field sequence, if the data set read from the storage means is prepared for generating the second sub field sequence.

Moreover, the selecting means may select the data set prepared for generating the second sub field sequence by the generating means while the vertical synchronization signal is not being supplied.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

Figure 1A:
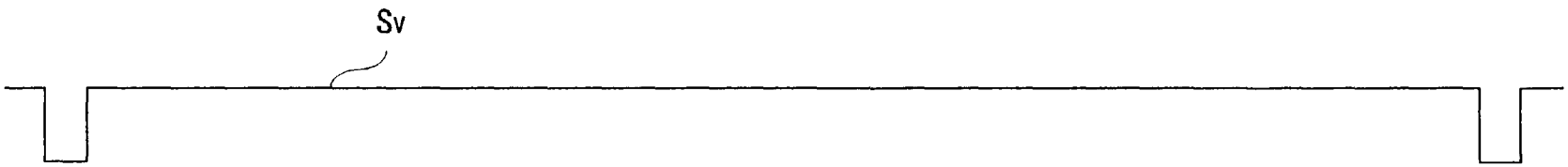
FIG. 1A (PRIOR ART)
FIGS. 1A and 1B are diagrams for explaining a conventional sub field sequence for driving a plasma display panel.
Figure 1B:
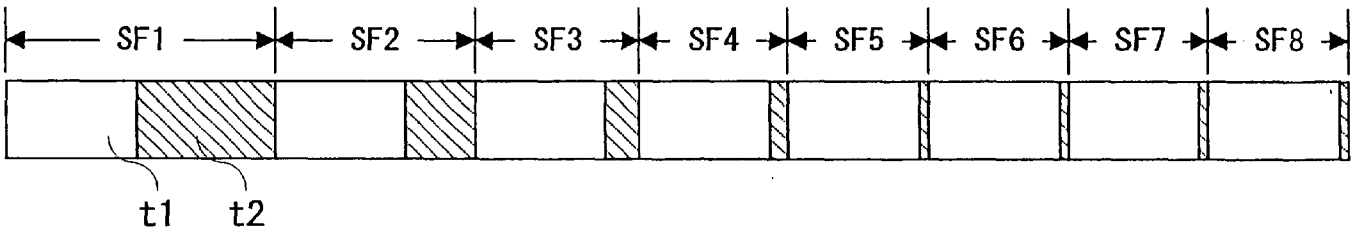
FIG. 1B (PRIOR ART)
Figure 2:
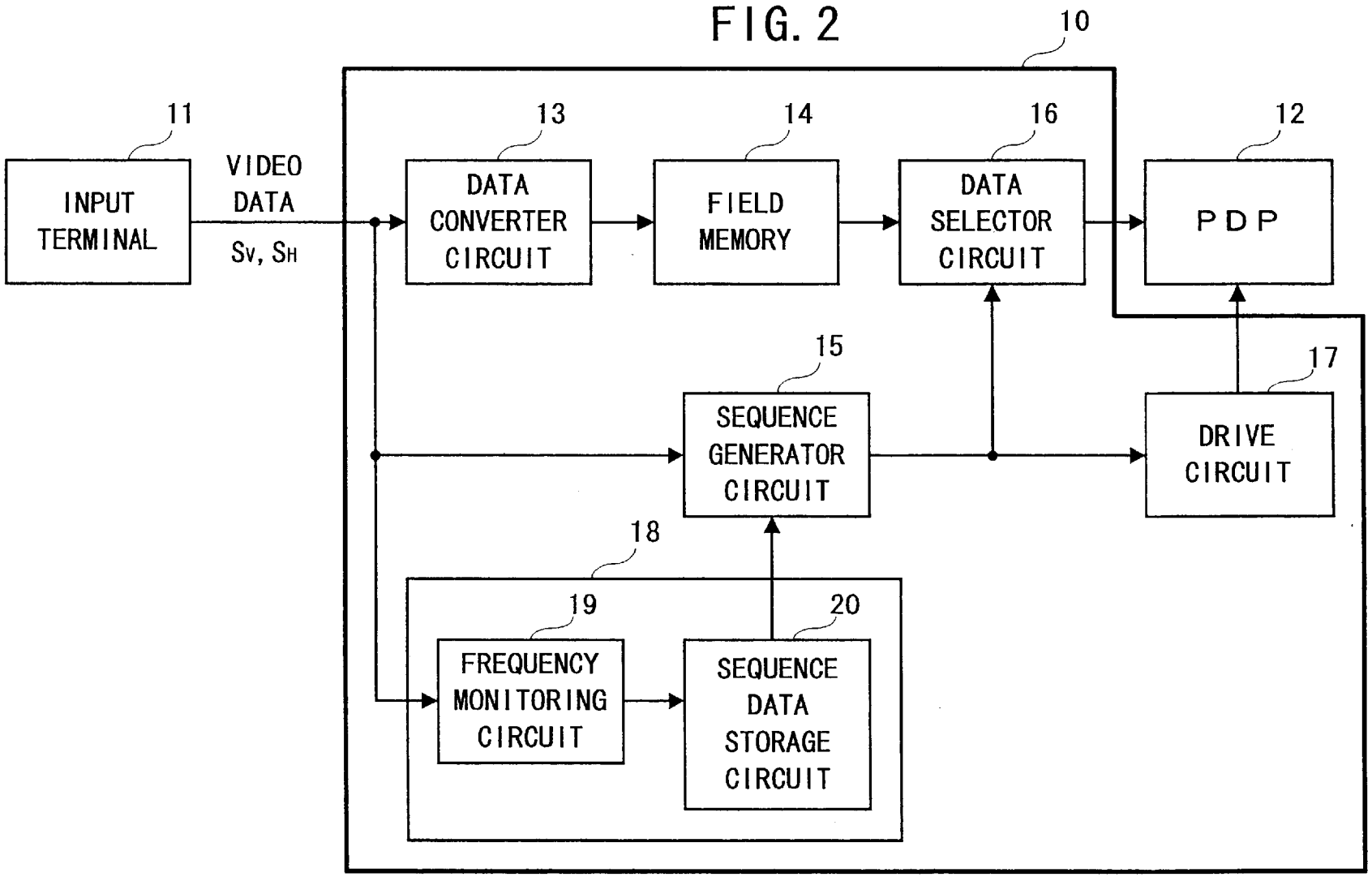
FIG. 2 is a diagram showing the structure of a drive device according to the embodiment of the present invention.

An embodiment of the present invention will now be described with reference to the accompanying drawings. FIG. 2 is a diagram showing the structure of a dive device 10 for a plasma display panel, according to the embodiment of the present invention.

As shown in FIG. 2, the drive device 10 drives a plasma display panel (PDP) 12 in accordance with a video signal, a horizontal synchronization signal $S_H$, and a vertical synchronization signal $S_V$ which are supplied through an input terminal 11, thus the PDP 12 displays an image. The drive device 10 comprises a signal converter circuit 13, a field memory 14, a sequence generator circuit 15, a data selector circuit 16, a drive circuit 17, and a sequence regulator circuit 18.

The signal converter circuit 13 receives the video signal, the horizontal synchronization signal $S_H$, and the vertical synchronization signal $S_V$, and converts them into data to be written on the field memory 14.

The field memory 14 is a RAM (Random Access Memory) or the like, and stores the data converted by the signal converter circuit 13. The data in the field memory 14 is readable by the data selector circuit 16 asynchronous with data writing by the signal converter circuit 13.

The sequence generator circuit 15 generates a drive sequence which indicates steps for driving the PDP 12. The sequence generator circuit 15 supplies the generated drive sequence to the data selector circuit 16 and the drive circuit 17.

The data selector circuit 16 reads the data in the field memory 14 at a timing in accordance with the drive sequence generated by the sequence generator circuit 15, and supplies the read data to the PDP 12.

The drive circuit 17 generates a drive signal corresponding to the drive sequence supplied from the sequence generator circuit 15, and supplies the generated drive signal to the PDP 12.

The sequence regulator circuit 18 is prepared for regulating the drive sequence generated by the sequence generator circuit 15 in accordance with frequency of the vertical synchronization signal $S_V$ input through the input terminal 11. The sequence regulator circuit 18 comprises a frequency monitoring circuit 19 and a sequence data storage circuit 20.

The frequency monitoring circuit 19 specifies the frequency of the vertical synchronization signal $S_V$ input through the input terminal 11 while monitoring it. The frequency monitoring circuit 19 generates a signal for selecting a sequence data set from sequence data sets stored in the sequence data storage circuit 20 in accordance with the specified frequency of the vertical synchronization signal $S_V$. The generated signal is supplied to the sequence data storage circuit 20.

The sequence data storage circuit 20 previously stores plural kinds of the data sets each prepared for generating a drive sequence by the sequence generator circuit 15 based on the frequency of the vertical synchronization signal $S_V$. The sequence data storage circuit 20 allows the sequence generator circuit 15 to read one of the sequence data sets corresponding to the signal supplied from the frequency monitoring circuit 19.

Figure 3:
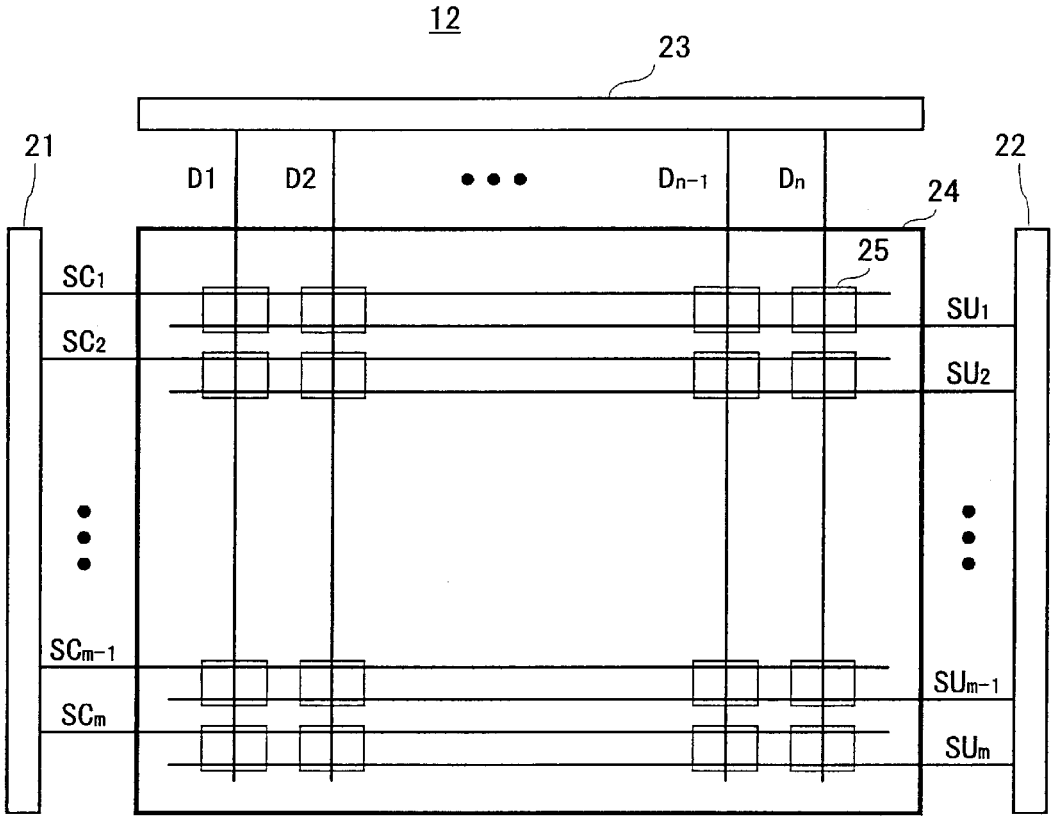
FIG. 3 is a diagram showing the structure of a plasma display panel (PDP)

FIG. 3 is a diagram showing the structure of the PDP 12. As shown in FIG. 3, the PDP 12 comprises a scan driver 21, a common driver 22, a data driver 23, and a cell array 24. In the cell array 24, discharge cells 25 are arranged. In every line of the cell array 24, the discharge cells 25 are arranged so as to emit lights of red, green and blue in this order. The PDP 12 is a dot matrix type display panel in which the cell array 24 has m lines and n columns.

Scan electrodes SC1, SC2, . . . , SCm and common electrodes SU1, SU2, . . . , SUm are arranged in the cell array 24 in parallel to the lines. Those electrodes control operation of the discharge cells 25. And, data electrodes D1, D2, . . . , Dn are arranged in the cell array 24 in parallel to the columns. The data electrodes also control operation of the discharge cells 25.

The scan driver 21 generates voltage signals in accordance with the drive sequence, and applies them to the scan electrodes SC1 to SCm. The common driver 22 generates voltage signals in accordance with the drive sequence, and applies them to the common electrodes SU1 to SUm. The scan driver 21 and the common driver 22 specify the drive sequence based on the drive signal supplied from the drive circuit 17.

The data driver 23 generates voltage signals in accordance with the data signal supplied from the data selector circuit 16, and applies them to the data electrodes D1 to Dn.

FIGS. 4A to 4F exemplify the voltage signals to be applied to the scan electrodes SC1–SCm, the common electrodes SUx (x; 0–m), and the data electrodes Dy (y; 0–n), for driving the PDP 12.

Figure 4A:
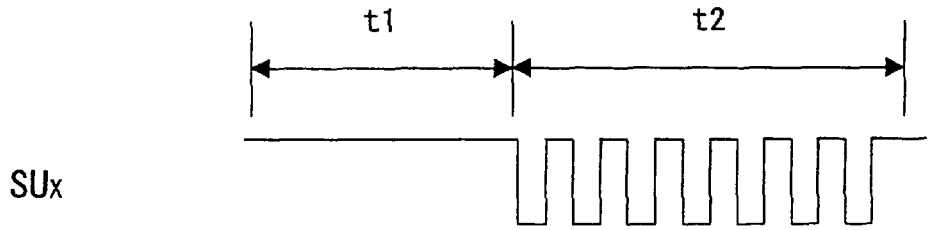
FIGS. 4A to 4F are diagrams exemplifying voltage signals to be applied to the plasma display panel (PDP) for driving it.

FIG. 4A is a diagram showing the voltage signal to be applied to the common electrodes SUx (x; 0–x). As shown in FIG. 4A, the common driver 22 applies a constant voltage to the common electrode SUx during a later described scan period t1, and applies a pulse voltage representing the number of outputs by cell 25 thereto during a later described sustain period t2.

Figure 4B:
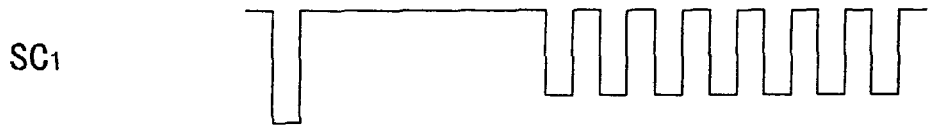

FIG. 4B is a diagram showing the voltage signal to be applied to the scan electrode SC1. As shown in FIG. 4B, the scan driver 21 applies a write pulse $P_W$1 which designates phase (output or rest) of each cell 25 to the scan electrode SC1 during the later described scan period t1, and applies a pulse voltage representing the number of outputs by the cells 25 thereto during the later described sustain period t2.

Figure 4C:
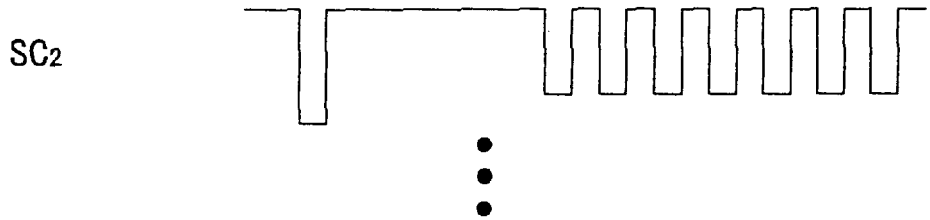
Figure 4D:
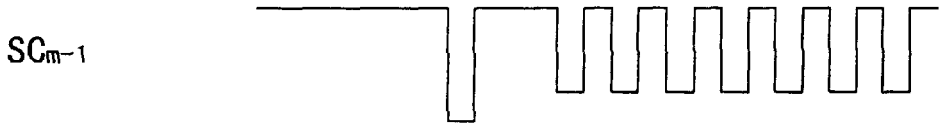
Figure 4E:
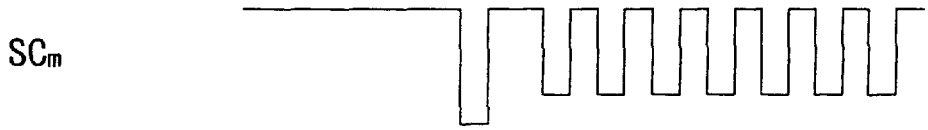

FIG. 4C is a diagram showing the voltage signal to be applied to the scan electrode SC2, and FIGS. 4D and 4E show voltage signals to be applied to the scan electrode SCm–1 and SCm respectively. The scan driver 21 applies a write pulse $P_W$z to the scan electrodes SCz (z; 0–m) during the later described scan period t1. The write pulse $P_W$z designates the phase (output or rest) of each cell 25. The scan driver 21 also applies a pulse voltage to the scan electrodes SCz during the later described scan period t2. The pulse voltage is prepared for controlling the number of outputs of each cell 25.

Figure 4F:
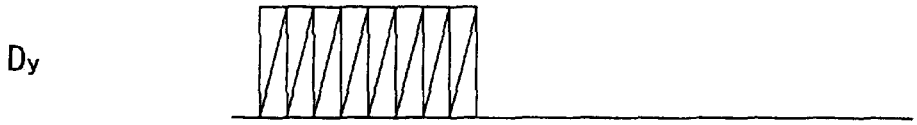

FIG. 4F is a diagram showing a voltage signal to be applied to the data electrodes Dy (y; 0–n). As shown in FIG. 4F, the data driver 23 applies a voltage signal to the data electrodes Dy during the later described scan period t1. The voltage signal indicates the phase (output or rest) of each cell 25.

Operations of the device according to the embodiment of the present invention will now be described. The drive device 10 shown in FIG. 2 is able to select sequences for driving the PDP 12 in accordance with the frequency of the vertical synchronization signal $S_V$ input through the input terminal 11.

Figure 5A:
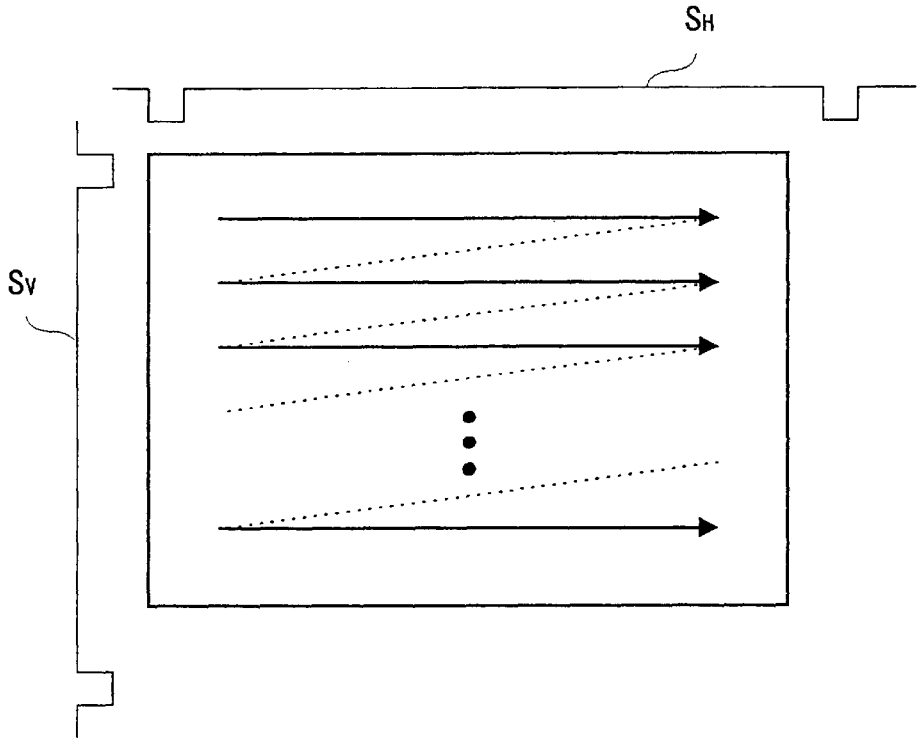
FIGS. 5A and 5B are diagrams each schematically showing a relationship between signals input through an input terminal and an image to be displayed on the plasma display panel (PDP)
Figure 5B:
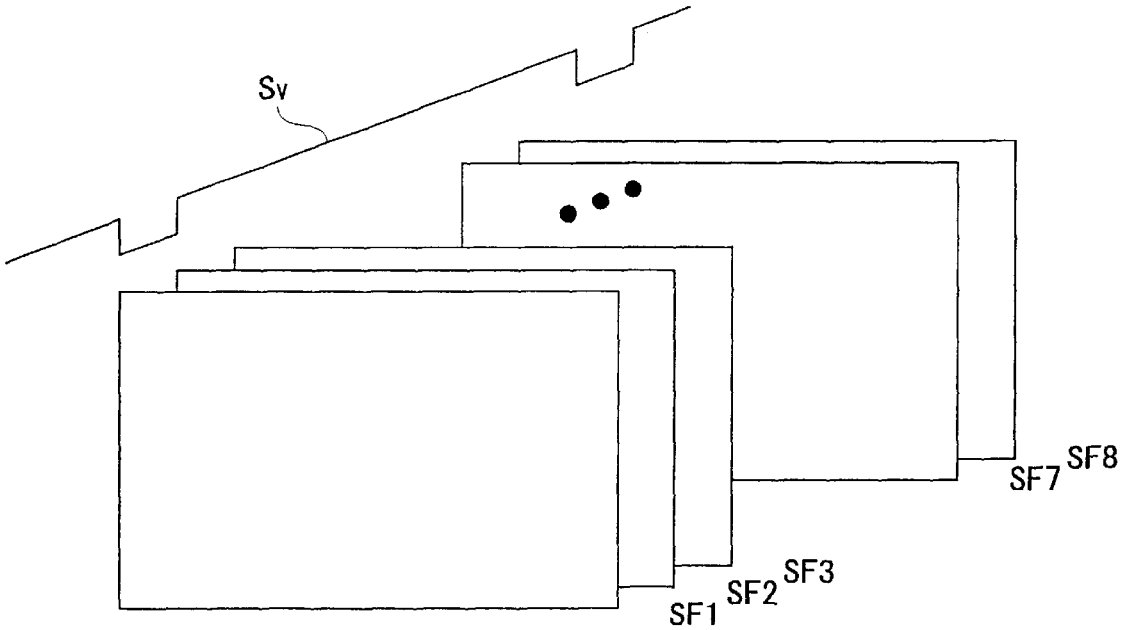

FIGS. 5A and 5B are diagrams schematically showing the relationship between the input signals from the input terminal 11 and an image to be displayed on the PDP 12. FIG. 5A schematically shows the signal input through the input terminal 11, and FIG. 5B schematically shows the signal for displaying an image on the PDP 12.

In the PDP 12, it is difficult to control the brightness level by controlling a voltage. This fact allows each cell 25 of the PDP 12 to have only two selectable phases, output or rest. In order to display an image having various brightness levels on the PDP 12, the drive device 10 controls the number of outputs per a unit of time for every cell of the PDP 12. The drive device 10 employs the sub field sequence as a drive sequence for controlling the number of outputs.

FIGS. 6A to 6E are diagrams for explaining the sub field sequence employed in the drive device 10.

Figure 6A:
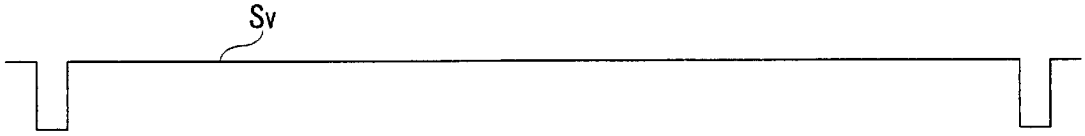
FIGS. 6A to 6E are diagrams for explaining the sub field sequences to be employed for driving the plasma display panel (PDP) according to the embodiment.
Figure 6B:
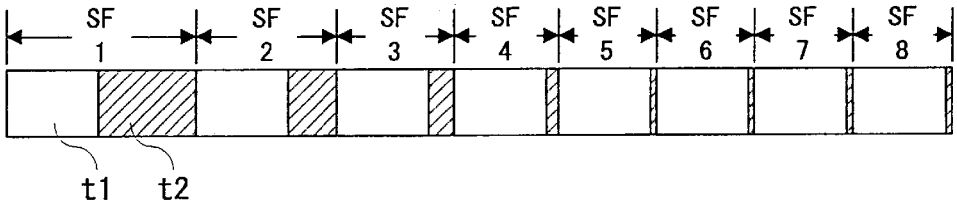

FIG. 6B shows a sub field sequence to be employed by the drive device 10 when a vertical synchronization signal $S_V$ having normal frequency as shown in FIG. 6A is input through the input terminal 11. When the frequency of the vertical synchronization signal $S_V$ is 60 Hz which is utilized in a video signal for, for example, NTSC (National Television System Committee) or HDTV (High Definition Television), the drive device 10 drives the PDP 12 with the normal sub field sequence shown in FIG. 6B.

Figure 6C:
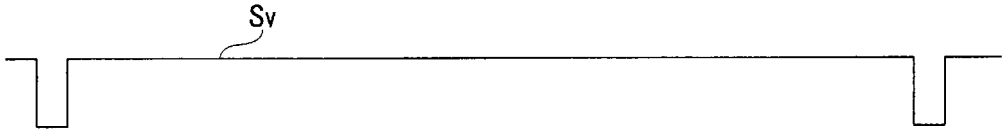
Figure 6D:
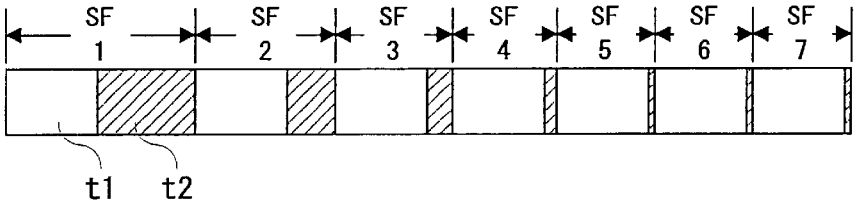
Figure 6E:
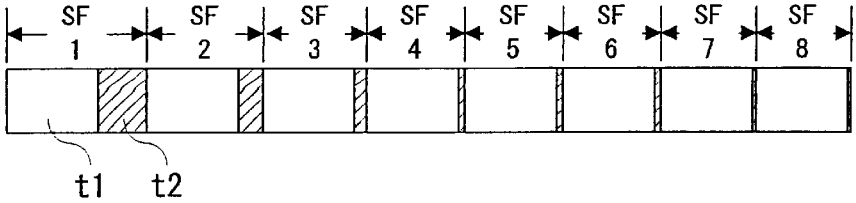

FIGS. 6D and 6E show sub field sequences to be employed by the drive device 10 when a vertical synchronization signal $S_V$ whose frequency is higher than normal as shown in FIG. 6C. The drive device 10 drives the PDP 12 with the sub field sequence shown in FIG. 6D or 6E when it receives a signal from, for example, a VCR (Video Cassette Recorder) performing play back option (fast forward, rewind, etc.), a video game device, or the like.

The sub field sequence shown in FIG. 6D has less sub fields in a field than those of the normal sub field sequence shown in FIG. 6B. More precisely, the sub field SF8 for the LSB (Least Significant Bit) is eliminated in the sub field sequence shown in FIG. 6D.

The sub field sequence shown in FIG. 6E has less sustain pulses in each of the sub fields SF1 to SF8 than those of the normal sub field sequence FIG. 6B. The reduction rate of the sustain pulses for each sub field is constant.

Moreover, the drive device 10 may employ a sub field sequence having less sub fields and sustain pulses than those of the normal sub field sequence shown in FIG. 6B, in order to control output operations of the PDP 12.

Accordingly, the drive device 10 employs a sub field sequence whose field length is shorter than that of the normal sub field sequence to drive the PDP 12 when the vertical synchronization signal input through the input terminal 11 has higher frequency than a predetermined frequency.

Each of the sub field sequences shown in FIGS. 6B, 6D and 6E has the scan period t1 and the sustain period t2. The scan period t1 is a period which allows the drive device 10 to scan the cell array 24 in order to determine the phases (output and rest) of each cell 25 and designate the determined phases to the cells 25. The sustain period t2 is a period which allows the drive device 10 to control the cells 25 so that the cells 25 in the output phase based on the determination during the scan period t1 emit lights.

In addition to the scan and sustain periods t1 and t2, the sub field sequence may have a pre-discharge period or the like for stable writing to the cells.

The frequency monitoring circuit 19 specifies the frequency of the vertical synchronization signal $S_V$ input through the input terminal 11. Then, the frequency monitoring circuit 19 generates a signal for selecting a sequence data set corresponding to the specified frequency from the sequence data sets in the sequence data storage circuit 20, and supplies the signal to the sequence data storage circuit 20.

For example, when a vertical synchronization signal $S_V$ whose frequency is 60 Hz which is suitable for the NTSC or HDTV is input through the input terminal 11, the frequency monitoring circuit 19 supplies a signal to the sequence data storage circuit 20 for the sequence data selection in order to generate the sub field sequence shown in FIG. 6B by the sequence generator circuit 15.

The sequence generator circuit 15 reads an appropriate sequence data set from the sequence data sets in the sequence data storage circuit 20. The appropriate sequence data set is a sequence data set corresponding to the signal generated by the frequency monitoring circuit 19. The sequence data storage circuit 20 allows the sequence generator circuit 15 to read only the appropriate sequence data set based on the supplied signal.

Thus, the sequence regulator circuit 18 regulates a drive sequence to be generated by the sequence generator circuit 15.

In other case where, for example, a signal is input through the input terminal 11 from the VCR performing the play back option, the video game device, or the like, the frequency monitoring circuit 19 supplies a signal to the sequence data storage circuit 20 for the sequence data selection in order to generate the sub field sequence shown in FIG. 6D or 6E by the sequence generator circuit 15.

The sequence generator circuit 15 reads an appropriate sequence data set from the sequence data sets in the sequence data storage circuit 20, and generates a drive sequence based on the read sequence data set.

The sequence generator circuit 15 supplies the generated drive sequence to the data selector circuit 16 and the drive circuit 17.

The data selector circuit 16 reads the data from the field memory 14 at a timing in accordance with the drive sequence supplied from the sequence generator circuit 15, and supplies the read data to the PDP 12.

Thus, the drive device 10 drives the PDP 12 with the shortened sub field sequence when the high frequency vertical synchronization signal $S_V$ is input through the input terminal 11.

Techniques disclosed in Unexamined Japanese Patent Application KOKAI Publication Nos. H10-187094 and H10-214059 may be applicable as a method for obtaining the sub field sequence shown in FIG. 6D in which the sub fields are reduced. The disclosures of those applications are incorporated herein by reference in its entirety.

Moreover, a technique disclosed in Unexamined Japanese Patent Application KOKAI Publication No. H10-307562 may be applicable as a method for obtaining the sub field sequence shown in FIG. 6E in which the sustain pulses are reduced.

Furthermore, the drive device 10 drives the PDP 12 with the shortened sub field sequence shown in FIG. 6D or 6E during supply intervals of the vertical synchronization signal $S_V$. More precisely, the frequency monitoring circuit 19 supplies a signal to the sequence data storage circuit 20 for the sequence data selection in order to generate the sub field sequence shown in FIG. 6D or 6E by the sequence generator circuit 15 during no vertical synchronization signal $S_V$ is being supplied through the input terminal 11.

Accordingly, the drive device 10 can drive the PDP 12 without failures even if a high frequency vertical synchronization signal $S_V$ is supplied to the drive device 10 at beginning.

The operational characteristics of the PDP 12 do not permit the drive device 10 to quit the operation while the drive sequence is being activated. Moreover, the drive device 10 must synchronize the drive sequence with the vertical synchronization signal $S_V$ during a period where the field sequences are not being generated. Under those circumstances, the drive device 10 utilizes the shortened sub field sequence for driving the PDP 12 during the supply intervals of the vertical synchronization signal $S_V$, in order to quickly establish the synchronization for driving the PDP 12 properly.

Figure 7:
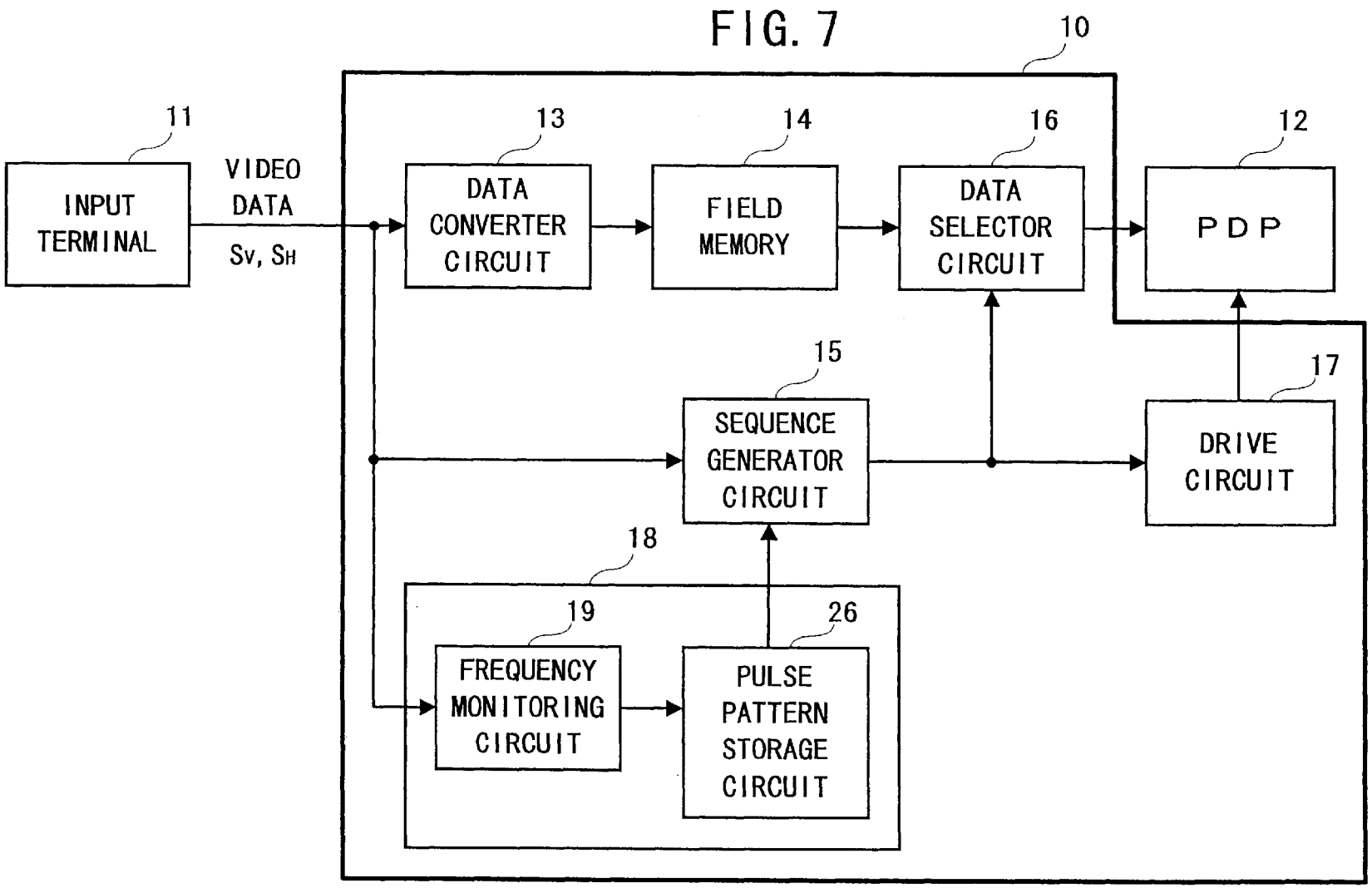
FIG. 7 is a diagram showing the structure of a drive circuit which obtains a shortened sub field sequence by reducing a sustain pulse.

In a case where the shortened sub field sequence having reduced sustain pulses shown in FIG. 6E is used, the sequence data storage circuit 20 acts as a pulse pattern storage circuit 26 as shown in FIG. 7.

In this case, the frequency monitoring circuit 19 supplies a signal for pulse pattern selection to the pulse pattern storage circuit 26 when the vertical synchronization signal $S_V$ whose frequency is higher than normal frequency is input through the input terminal 11, in order to generate a drive sequence for sustain pulse reduction by the sequence generator circuit 19.

Then, the sequence generator circuit 15 reads an appropriate pulse pattern data set from pulse pattern data sets in the pulse pattern storage circuit 26. The appropriate pulse pattern data is a pulse pattern data set corresponding to the signal generated by the frequency monitoring circuit 19. The pulse pattern data storage circuit 26 allows the sequence generator circuit 15 to read only the appropriate pulse data set based on the signal supplied from the frequency monitoring circuit 19.

The drive device 10 may shorten the sub field sequence by reduction of both sub fields and sustain pulses.

As described above, the drive device 10 shortens the sub field sequence by reducing the sub fields or sustain pulses when the frequency of the input vertical synchronization signal $S_V$ is higher than a predetermined frequency, in order to properly display an image having various brightness levels on the PDP 12.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. H11-061342 filed on Mar. 9, 1999 and including specification, claims, drawings and summary. The disclosure of the above Japanese Patent Application is incorporated herein by reference in its entirety.

What is claimed is:

1. A method for driving a plasma display panel utilizing sub field sequences in which each field has a plurality of sub fields, said method comprising:

driving said plasma display panel utilizing a standard sub field sequence when a frequency of an externally supplied vertical synchronization signal is a normal frequency;

driving said plasma display panel utilizing a non-standard sub field sequence which is shorter than the standard sub field sequence when the vertical synchronization signal is not externally supplied;

storing at least one data set prepared for generating said standard and non-standard sub field sequences in accordance with the frequency of the vertical synchronization signal; and selecting a data set prepared for generating the non-standard sub field sequence, wherein said data set is selected as a readable data set while the vertical synchronization signal is not being supplied.

2. The method according to claim 1, wherein the frequency of the externally supplied vertical synchronization signal is a frequency which meets a standard of a television signal.

3. The method according to claim 2, further comprising driving said plasma display panel utilizing the non-standard sub field sequence when the frequency of the vertical synchronization signal, which is included in an externally and continuously supplied video signal, gradually increases from the frequency meeting the standard of the television signal to a frequency that is higher than a predetermined frequency.

4. The method according to claim 3, wherein the frequency that is higher than the predetermined frequency is a frequency of a signal input from a video cassette recorder in a special playback mode.

5. The method according to claim 1, wherein the non-standard sub field sequence is a sub field sequence in which a sub field corresponding to a lower significant bit of the standard sub field sequence is missing, or a sub field sequence including less sustain pulses than the standard sub field sequence.

6. A device for driving a plasma display panel utilizing sub field sequences in which each field has a plurality of sub fields, said device comprising:

generating means for generating the sub field sequences;

drive means for driving said plasma display panel in accordance with the sub field sequences generated by said generating means;

storage means for storing plural kinds of data sets for generating plural kinds of the sub field sequences by said generating means; and selecting means for specifying a frequency of an externally supplied vertical synchronization signal, and for selecting a specific one of the plural data sets which is readable by said generating means from the data sets stored in said storage means in accordance with the specified frequency, wherein said selecting means selects an individual one of the data sets for generating a standard sub field sequence by said generating means from the plural data sets stored in said storage means as the readable data set when the frequency of the externally supplied vertical synchronization signal is a normal frequency, and selects another individual one data set for generating a non-standard sub field sequence which is shorter than the standard sub field sequence as the readable data set when the vertical synchronization signal is not externally supplied, and said generating means reads the readable data set from said storage means and generates the sub field sequence in accordance with the read data set.

7. The device according to claim 6, wherein the non-standard sub field sequence is a sub field sequence in which a sub field corresponding to a lower significant bit of the standard sub field sequence is missing, or a sub field sequence including less sustain pulses than the standard sub field sequence.

8. The method according to claim 2, wherein the non-standard sub field sequence is a sub field sequence in which a sub field corresponding to a lower significant bit of the standard sub field sequence is missing, or a sub field sequence including less sustain pulses than the standard sub field sequence.

9. The method according to claim 3, wherein the non-standard sub field sequence is a sub field sequence in which a sub field corresponding to a lower significant bit of the standard sub field sequence is missing, or a sub field sequence including less sustain pulses than the standard sub field sequence.

10. The method according to claim 4, wherein the non-standard sub field sequence is a sub field sequence in which a sub field corresponding to a lower significant bit of the standard sub field sequence is missing, or a sub field sequence including less sustain pulses than the standard sub field sequence.

11. A method for driving a plasma display panel utilizing sub field sequences in which each field has a plurality of sub fields, said method comprising:

driving said plasma display panel utilizing a standard sub field sequence when a frequency of an externally supplied vertical synchronization signal is a normal frequency;

driving said plasma display panel utilizing a non-standard sub field sequence which is shorter than the standard sub field sequence when the vertical synchronization signal is not externally supplied; and controlling a brightness level of a displayed image, wherein said plasma display panel includes at least one cell and each cell of said at least one cell has two selectable phases, output and rest, and wherein a number of outputs per a unit of time for each cell is controlled by said standard sub field sequence when said vertical synchronization signal is externally supplied and said non-standard sub field sequence when said vertical synchronization signal is not externally supplied.

* * * * *